US007597052B2

(12) United States Patent
Malfent et al.

(10) Patent No.: US 7,597,052 B2
(45) Date of Patent: Oct. 6, 2009

(54) ANTICLIMBER FOR RAILROAD VEHICLES

(75) Inventors: Thomas Malfent, Vienna (AT); Andreas Rittenschober, Vienna (AT); Thomas Meissl, Obersdorf (AT); Martin Jüly, Margarethen (AT)

(73) Assignee: Siemens Transportation Systems GmbH & Co. KG, Vienna (AT)

( * ) Notice: Subject to any disclaimer, the term of this patent is extended or adjusted under 35 U.S.C. 154(b) by 19 days.

(21) Appl. No.: 11/658,421

(22) PCT Filed: Jul. 7, 2005

(86) PCT No.: PCT/AT2005/000255

§ 371 (c)(1),
(2), (4) Date: Nov. 14, 2007

(87) PCT Pub. No.: WO2006/010176

PCT Pub. Date: Feb. 2, 2006

(65) Prior Publication Data

US 2008/0314282 A1 Dec. 25, 2008

(30) Foreign Application Priority Data

Jul. 28, 2004 (AT) ..... A 1289/2004

(51) Int. Cl.
*B61D 15/06* (2006.01)
*B61D 17/00* (2006.01)
*B61G 11/00* (2006.01)

(52) U.S. Cl. ..... 105/392.5; 105/396; 213/220

(58) Field of Classification Search ..... 105/392.5, 105/396; 213/220–222; 296/187.03, 187.09; 293/133, 154

See application file for complete search history.

(56) References Cited

U.S. PATENT DOCUMENTS

| | | | | |
|---|---|---|---|---|
| 4,184,434 | A * | 1/1980 | Chapin | 105/456 |
| 5,579,699 | A * | 12/1996 | Dannawi et al. | 105/416 |
| 6,561,105 | B2 * | 5/2003 | Godin et al. | 105/396 |
| 6,688,237 | B2 * | 2/2004 | Back et al. | 105/392.5 |
| 6,712,007 | B2 * | 3/2004 | Yamamoto et al. | 105/392.5 |
| 2004/0159263 | A1 * | 8/2004 | Yamamoto et al. | 105/392.5 |
| 2007/0131135 | A1 * | 6/2007 | Moser et al. | 105/8.1 |

(Continued)

FOREIGN PATENT DOCUMENTS

EP 1 006 034 A1 6/2000

(Continued)

OTHER PUBLICATIONS

English translation of WO 2004/110842 A1, published Dec. 23, 2004 in the name of Wilhelm Mayer listed above.

(Continued)

*Primary Examiner*—S. Joseph Morano
*Assistant Examiner*—Jason C Smith
(74) *Attorney, Agent, or Firm*—Christie, Parker & Hale, LLP

(57) ABSTRACT

A rail vehicle comprising an anticlimber disposed in a vehicle end region and extending over substantially the entire width of the vehicle, wherein there is disposed, in the end region of the rail vehicle, at least one anticlimber element forming a partial vertical extension of the anticlimber, which anticlimber element is capable of engaging the anticlimber of another rail vehicle in the event of a collision.

3 Claims, 4 Drawing Sheets

U.S. PATENT DOCUMENTS

| | | | | |
|---|---|---|---|---|
| 2007/0186802 | A1 * | 8/2007 | Gough | 105/392.5 |
| 2007/0261591 | A1 * | 11/2007 | Bravo et al. | 105/392.5 |
| 2008/0006173 | A1 * | 1/2008 | Mayer | 105/392.5 |
| 2008/0250965 | A1 * | 10/2008 | Clark et al. | 105/413 |
| 2008/0314282 | A1 * | 12/2008 | Malfent et al. | 105/392.5 |

FOREIGN PATENT DOCUMENTS

| | | | |
|---|---|---|---|
| EP | 1006034 | A1 * | 6/2000 |
| EP | 1 394 009 | A1 | 3/2004 |
| WO | WO 2004/110842 | A1 | 12/2004 |
| WO | WO 2004110842 | A1 * | 12/2004 |
| WO | WO 2006010176 | A1 * | 2/2006 |

OTHER PUBLICATIONS

*Herstellung von Schienenfahrzeugen*.("Manufacturing of Railway Carriages"), ZEV + DET Glas. Ann. vol. 123, (1999) (English abstract provided).

International Search Report mailed Oct. 24, 2005 for corresponding International Patent Application No. PCT/AT2005/000255.

* cited by examiner

ANTICLIMBER FOR RAILROAD VEHICLES

CROSS-REFERENCE TO RELATED PATENT APPLICATION

This application is a National Phase Patent Application of International Application Number PCT/AT05/000255, filed on Jul. 7, 2005, which claims priority of Austrian Utility Model Number A 1289/2004, filed on Jul. 28, 2004.

BACKGROUND OF THE INVENTION

1. Field of the Invention

The invention relates to a rail vehicle equipped with an anticlimber disposed at one end of the vehicle and extending over substantially the entire width of the vehicle.

2. Description of Related Art

In the event of a collision between two rail vehicles, there is the risk of one vehicle body being pushed up over the other with a certain degree of vertical misalignment, by which means considerable damage to the passenger compartment will be caused. To prevent this, it has been usual in recent years to provide the end regions of vehicles with so-called anticlimbers.

An anticlimber of the type mentioned above, has been disclosed in U.S. Pat. No. 4,184,434 A, for example.

Usually, anticlimbers possess several parallel and horizontal fins, as may be seen, for example, from the drawings shown in FIGS. 1 to 3 of the prior art. In the case of the partially shown railroad carriage 1, an anticlimber 2 is disposed at both ends thereof and extends over substantially the entire side of the carriage such that in the event of a collision force can be diverted into the chassis region of the carriage. In the vicinity of the coupling 3, the anticlimber 2 becomes narrower or is interrupted. The anticlimber 2 projects beyond the end wall of the carriage, as shown in FIGS. 1 to 3. It might possess a cover, for example of fiberglass-reinforced plastics material, which in the event of a collision will be destroyed before mutual engagement of two anticlimbers takes place.

Known anticlimbers almost always compete with the coupling for space, for if the level of the coupling and that of the base of the carriage are fixed, there usually remains little space for an anticlimber when taking into consideration the movements of the coupling. This is shown, for example, in the article "Herstellung von Schienenfahrzeugen" ("Production of Rail Vehicles") in ZEV+DET Glas. Ann. 123 (1999). The space left for the anticlimber is in many cases too small for the installation of a continuous anticlimber.

The problem involved must be regarded as being that the total space occupied by the anticlimber is limited, as mentioned above, on account of the coupling, but it cannot be assumed, on the other hand, that when an accident occurs, the anticlimbers of two colliding carriages will be at exactly the same level.

This problem leads either to complete failure of the anticlimber or to some undefined force absorption taking place while at least partially by-passing the shock absorber system that is usually installed in railroad carriages.

It is therefore an object of the invention to provide a rail vehicle in which the aforementioned drawbacks are overcome as far as possible.

SUMMARY OF THE INVENTION

According to the invention, this object is achieved with a rail vehicle of the type mentioned above in that in the end region of the rail vehicle at least one anticlimber element is located which forms a partial extension of the anticlimber in a vertical direction and which is capable of engaging the anticlimber of the other rail vehicle in the event of a collision.

It is a merit of the invention that the force diversion occurring when two rail vehicles collide takes place, on account of the anticlimber element, at a higher level of engagement and is thus accurately measurable. Furthermore, it is of advantage that the space above the coupling remains substantially unused. Thus, thanks to the solution proposed by the invention, more space is available for the coupling together with the compressed air attachments and electrical components.

In a preferred embodiment of the invention, the at least one anticlimber element has fins which, in the event of a collision with another rail vehicle, is capable of engaging the fins of an anticlimber on the other rail vehicle.

Advantageously, at least one impact pillar is provided, whose longitudinal axis is substantially normal to the plane of the rails, the anticlimber element being disposed in the interior of the impact pillar.

Furthermore, the at least one impact pillar can be in the form of a thin-walled aluminum hollow profile, in which the at least one anticlimber element is disposed. The aluminum hollow profile can be dented when a collision occurs, which makes it possible for the anticlimber to engage the depressions in the anticlimber element.

Since the solution of the invention provides, depending on its design, sufficient space for an emergency exit, an advantageous variant of the invention consists in that the at least one impact pillar is in the form of a door pillar of an emergency exit.

BRIEF DESCRIPTION OF THE DRAWINGS

The invention, together with further advantages thereof, is explained in greater detail below with reference to some non-restricting exemplary embodiments illustrated in the drawings, in which.

DETAILED DESCRIPTION

Figure 2:
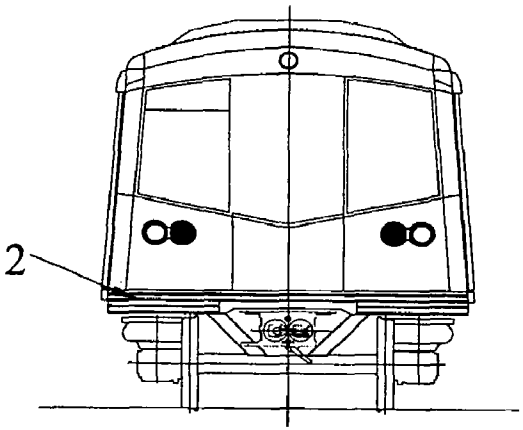
Fig. 2 PRIOR ART
FIG. 2 is a rear view of a conventional rail vehicle.
Figure 1:
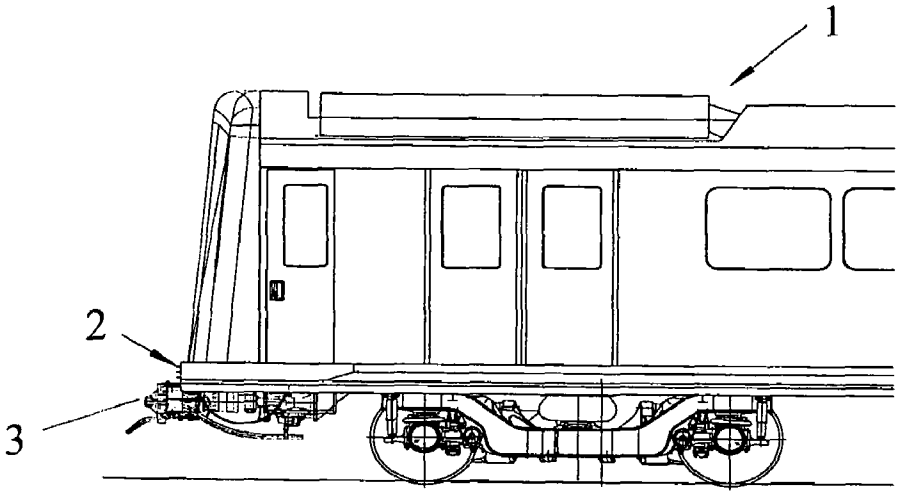
Fig. 1 PRIOR ART
FIG. 1 is a side view of a conventional rail vehicle.
Figure 3:
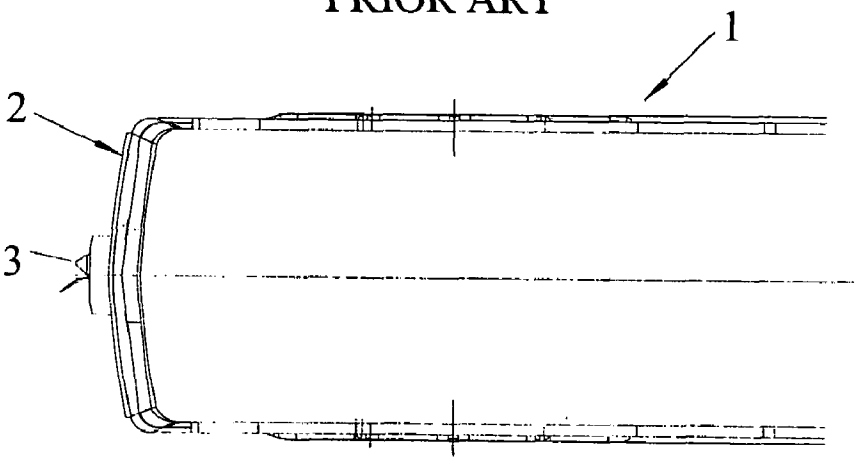
Fig. 3 PRIOR ART
FIG. 3 is a top view of a conventional rail vehicle.
Figure 4:
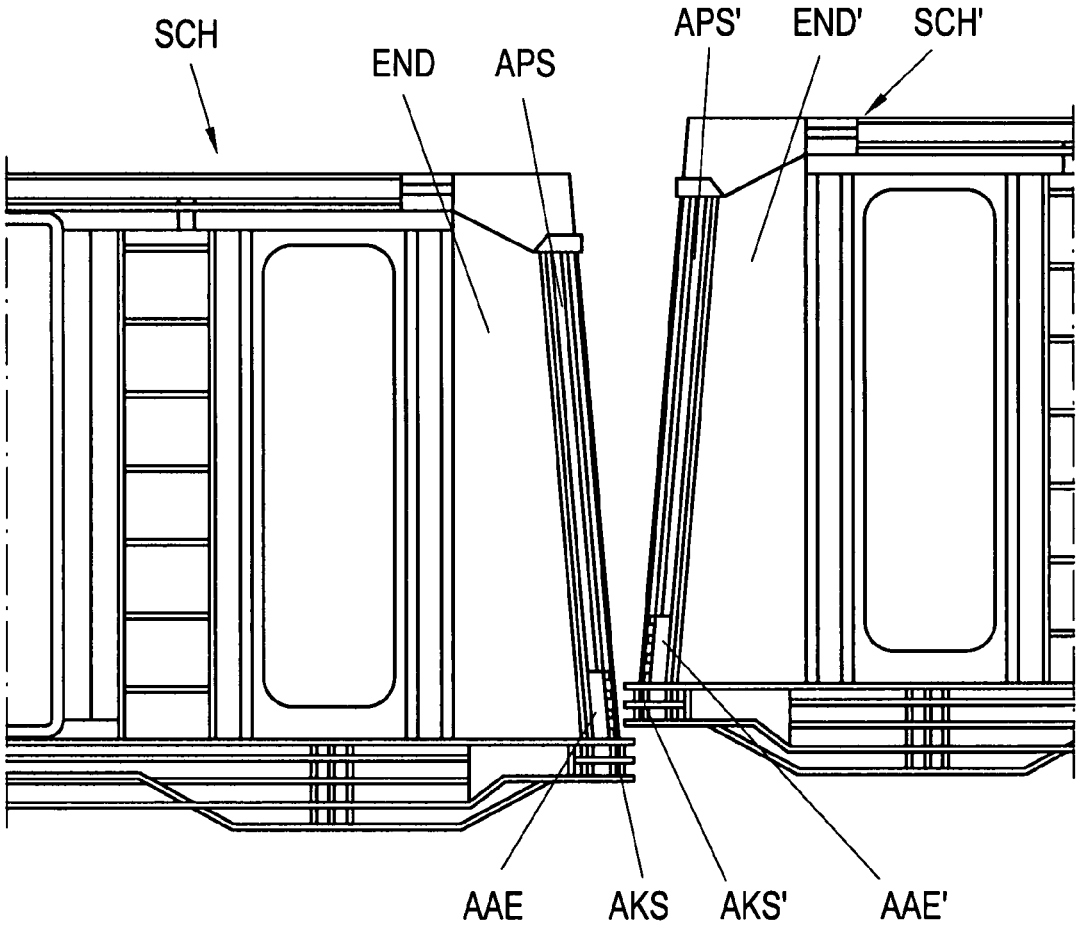
FIG. 4 is a side view of the end regions of two colliding rail vehicles of the invention.

According to FIG. 4, a rail vehicle of the invention SCH, SCH', which is preferably a railroad carriage, has anticlimbers AKS, AKS' at its ends END, END', which extend substantially over the entire width of the vehicle. In a preferred variant of the invention the rail vehicles SCH, SCH' are coupled to form a train rake.

Figure 5:
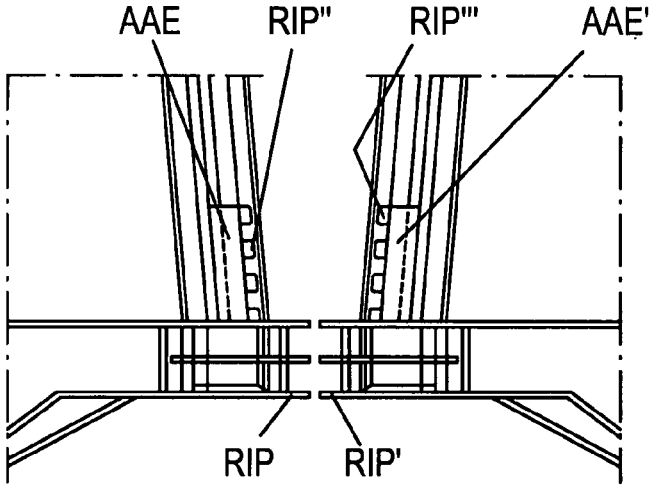
FIG. 5 illustrates the end regions of two coupled rail vehicles of the invention in a normal operation position.
Figure 6:
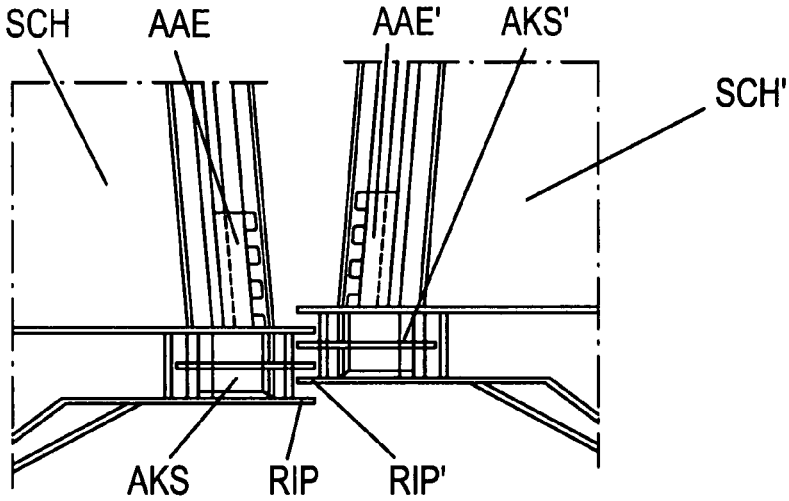
FIG. 6 shows the end regions illustrated in FIG. 5 in the event of a collision occurring with slight vertical misalignment of the participating rail vehicles.
Figure 8:
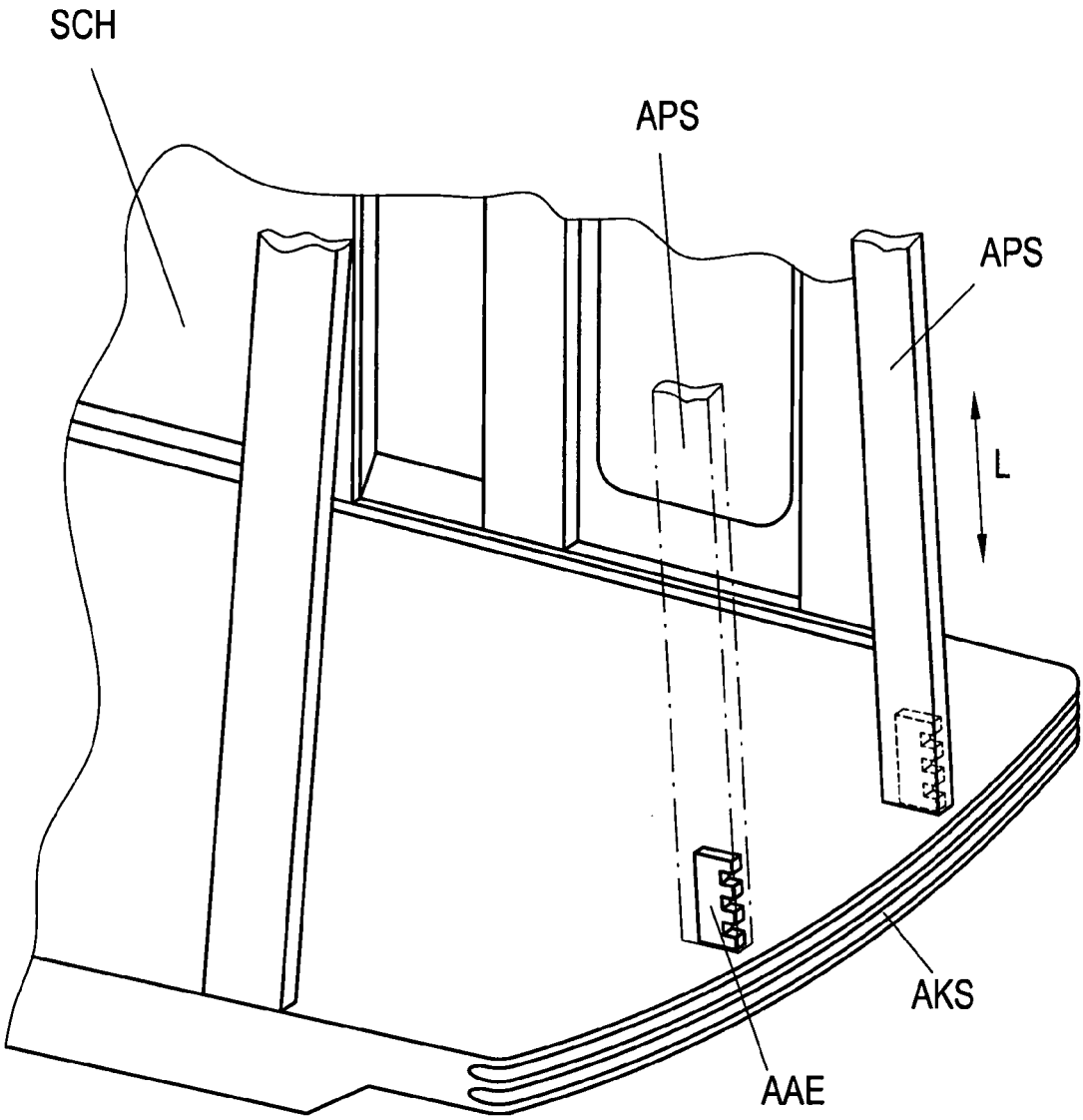
FIG. 8 is a perspective view of a front side of a rail vehicle of the invention.

The anticlimber AKS, AKS' has, in the embodiment illustrated, fins RIP, RIP' (FIG. 5). These fins RIP, RIP' extend horizontally and parallel to each other (FIG. 8). In this case there are three such fins RIP, RIP', and they can have a thickness of, say, 10 mm. The anticlimber AKS, AKS' consists of a steel or aluminum alloy or some other material commonly used for rail vehicles. In the event of a collision of the rail vehicles SCH, SCH' taking place with slight vertical misalignment of the rail vehicles SCH, SCH' relative to each other the anticlimbers AKS, AKS' can interlock and thus prevent climbing (FIG. 6).

In order to prevent climbing when there is a collision with a large vertical misalignment of the two rail vehicles SCH, SCH' relative to each other, there is provided an anticlimber element AAE, AAE' above the anticlimber AKS, AKS', which anticlimber element forms a partial vertical extension of the anticlimber AKS, AKS'.

The anticlimber elements AAE, AAE' are capable of engaging the anticlimber AKS, AKS' of another rail vehicle in the event of a collision. In the embodiment illustrated here two block shaped anticlimber elements AAE, AAE' are provided above each anticlimber AKS, AKS'.

The anticlimber elements AAE, AAE' represent a functional extension of the anticlimber AKS, AKS'. The anticlimber element AAE, AAE' which can be of the same material as the anticlimber AKS, AKS', likewise has fins RIP", RIP"'. The anticlimber element AAE, AAE' of a rail vehicle SCH, SCH' is set back from the anticlimber AKS, AKS' toward the vehicle body of said rail vehicle SCH, SCH' in the longitudinal direction of the vehicle.

Figure 7:
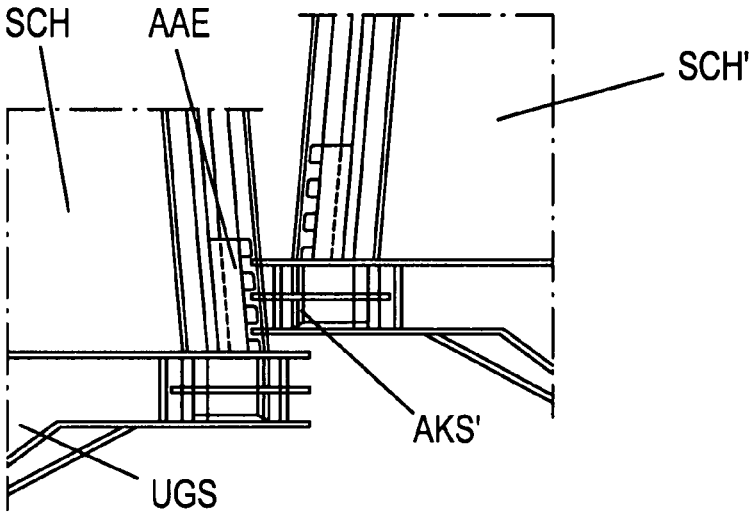
FIG. 7 shows the end regions illustrated in FIGS. 5 and 6 in the event of a collision occurring with a large vertical misalignment of the participating rail vehicles.

According to FIG. 7, the fins of the anticlimber element AAE can, in the event of a collision, engage the fins of an anticlimber AKS' of another rail vehicle SCH', by which means, according to the invention, climbing of the rail vehicle SCH' onto the rail vehicle SCH can be prevented.

The anticlimber element AAE, AAE' can be joined to the anticlimber AKS, AKS', for example, by welding, or alternatively it can be produced as a single unit with the anticlimber AKS, AKS'. The anticlimber element AAE, AAE' can, if appropriate, be produced as an independent structural element attached to an underframe UGS of the rail vehicle SCH.

In a preferred embodiment of the invention, the anticlimber element AAE is disposed in the interior of an impact pillar APS, APS', whose longitudinal axis L is substantially normal to the plane of the rails (FIG. 8). The impact pillar APS can be in the form of a thin-walled aluminum hollow profile, in which the anticlimber element AAE is disposed. In the event of a collision, the aluminum hollow profile can be dented with the result that the anticlimber AKS' can engage the anticlimber element AAE.

In order to assure good engagement of the anticlimber AKS, AKS' over the entire width of the vehicle SCH, SCH', preferably at least two anticlimber elements AAE, AAE' or impact pillars APS, APS' are provided at the front of the vehicle SCH, SCH'.

According to one embodiment of the invention, the impact pillars APS form pillars of an emergency exit disposed at the front of the vehicle (FIG. 8). This embodiment is, in particular, made possible by the fact that the space required for an emergency exit is present, since the anticlimber element AAE does not restrict the space available at floor level.

To summarize, it may be stated that it is a great merit of the invention that it enables a continuous anticlimber to be provided in a simple and cheap manner without incurring space conflicts with the coupling.

The invention claimed is:

1. A rail vehicle comprising: an anticlimber disposed in an end region of the vehicle and extending over substantially an entire width of the rail vehicle, at least one anticlimber element disposed in said end region of said rail vehicle as a partial vertical extension of said anticlimber, which anticlimber element is capable of engaging an anticlimber of another rail vehicle in the event of a collision wherein at least one impact pillar is provided, whose longitudinal axis is substantially perpendicular to the plane of the rails on which the rail vehicle travels, said anticlimber element being disposed in the interior of said impact pillar, and wherein said at least one anticlimber element exhibits fins which, in the event of a collision with another rail vehicle, are capable of engaging the fins of an anticlimber on said other rail vehicle.

2. A rail vehicle as defined in claim 1, wherein said at least one impact pillar is in the form of a thin-walled aluminum hollow profile in which said at least one anticlimber element is disposed.

3. A rail vehicle as defined in claim 1, wherein said at least one impact pillar is in the form of a door pillar of an emergency exit.

* * * * *